US008522649B2

(12) United States Patent
Yousufzai

(10) Patent No.: US 8,522,649 B2
(45) Date of Patent: Sep. 3, 2013

(54) SHINGLE POPPER

(76) Inventor: Jamal K Yousufzai, Toronto (CA)

( * ) Notice: Subject to any disclaimer, the term of this patent is extended or adjusted under 35 U.S.C. 154(b) by 541 days.

(21) Appl. No.: 12/708,913

(22) Filed: Feb. 19, 2010

(65) Prior Publication Data

US 2011/0203418 A1 Aug. 25, 2011

(51) Int. Cl.

| | |
|---|---|
| ***E04D 15/00*** | (2006.01) |
| ***B26B 3/00*** | (2006.01) |
| ***B66F 15/00*** | (2006.01) |
| ***B25C 11/00*** | (2006.01) |

(52) U.S. Cl.
USPC ..... 81/45; 30/169; 30/170; 30/171; 30/172; 254/18; 254/21; 254/25

(58) Field of Classification Search
USPC ..... 81/45; 254/18, 21, 25; 30/169–172; D8/89
See application file for complete search history.

(56) References Cited

U.S. PATENT DOCUMENTS

| | | | | |
|---|---|---|---|---|
| 1,218,145 | A * | 3/1917 | Whittier | 81/45 |
| 6,318,213 | B1 * | 11/2001 | Hendrix et al. | 81/45 |
| 2010/0307295 | A1 * | 12/2010 | Elliott | 81/45 |

* cited by examiner

*Primary Examiner* — Monica Carter
*Assistant Examiner* — Danny Hong
(74) *Attorney, Agent, or Firm* — Nasser Ashgrtz

(57) ABSTRACT

A shingle removal shovel is disclosed that comprises of a rectangular blade with slots and teeth on its front and back edges. This shingle popper has a special blade structure having elongated protrusions on its bottom side. Said protrusions provide a front and a back pivoting points so that the popper can be properly levered for easy removal of shingles and nails. The present shingle popper also has a slanted top surface to push shingles up while the shovel is moved under the shingle. It also has foot pedestals to allow an operator to use his/her foot to push the blade underneath a shingle.

4 Claims, 6 Drawing Sheets

SHINGLE POPPER

FIELD OF INVENTION

The present invention relates to a device for removing shingles and nails used on roofs.

BACKGROUND

Roof shingles are flat rectangular roof coverings, which are laid in rows from the bottom edge of the roof up with the bottom edge of each row overlapping the previous row. Roof shingles are usually made of fibreglass-based asphalt and are nailed on the roof. Shingles need to be replaced every so often to prevent water leakage into the building. Old shingles can be removed simply by a square-edged garden shovel and a pry-bar. Many shingle removing devices are developed to combine the nail removal capability of a pry-bar with the lever effect of a shovel. Most of these devices are similar to a garden shovel, having jagged edges to remove nails. These devices have been referred to as roof ripper, roofer's spade, shingle remover or shingle popper. The present device is a new shingle popper which has certain features to make it easier to remove shingles.

SUMMARY OF THE INVENTION

The present device is a shingle popper to remove shingles and nails from roofs of building. This garden shovel like shingle popper comprises of a substantially rectangular blade with slots and teeth on its front and back edges. This device can remove shingles off of a roof by applying a levering force onto its handle. The present shingle popper has several novel features over the prior art devices. One is the special structure of its blade. The blade of this device has elongated protrusions on its bottom side forming a front and a back pivoting points so that the popper can be properly levered for easy removal of shingles and nails. These protrusions are formed by stamping or pressing of the blank metal blade, resulting in plastic deformation of the metal piece, and therefore, forming a mechanically stronger blade. Another functionally significant element of the present shingle popper is that it has an extra metal piece welded on top of the blade. This top piece has three different functions: It provides extra structural support; it helps in pushing a shingle up away from the roof top by having a slanted top surface; and it has foot pedestals to allow an operator to use his/her foot to push the blade underneath a shingle.

One object of this shingle removing shovel is to provide a true levering effect by having fulcrum or pivoting point on the bottom side of the shovel blade. This is achieved by having double vertex protrusions built on the bottom side of the blade. These vertices allow the shovel to pivot around them making the shingle and nail removal easier.

Another object of this invention is to provide a stronger blade. Shovel blade is used to remove the nails and shingles and, therefore, it has to withstand large forces. Weak shovel blades will bend after some time and have to be replaced. One method of making the shovel blade stronger is to use thicker metal plates. However, this makes the shovel heavy and, therefore, makes the user tired quickly. The present invention uses metal stamping process to deform the plate into mechanically stronger form with high hardness. This makes the present shingle popper more durable without increasing its weight.

Another object of the present shingle popper is to collect the most possible nails in each stroke. This is achieved by having multiplicity of teeth and slots along its front and back edges.

Another object of the present shingle popper is to have ability to lift the shingle as the shovel is pushed under the shingle. This is achieved by adding a slanted surface onto the top surface of the shovel.

Another object of this popper is to allow for a specified up and down movement of the blade for easier removal of nails. Most nails used for installing shingles are either 1¼ or 1¾ inches long. The present popper is designed such that the edges of the blade can move these distances by a single stroke.

These and other objects of the present invention will become readily apparent upon further review of the following specification and drawings. To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the figures, which illustrate, by way of example only, embodiments of the present invention.

DETAILED DESCRIPTION OF THE INVENTION

Figure 1:
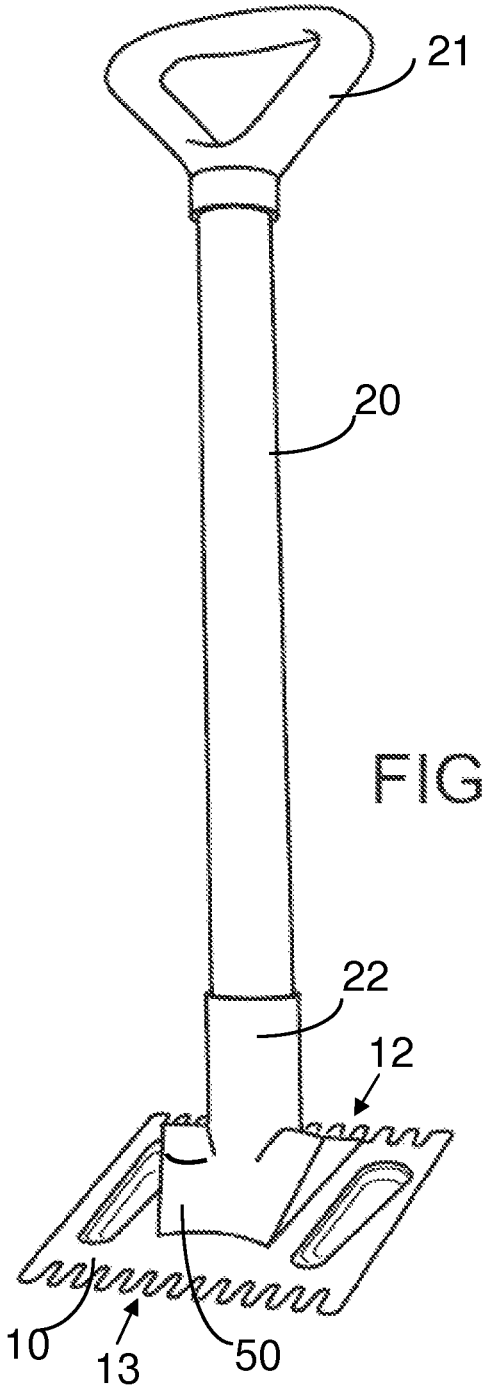
FIG. 1 is a perspective view of the present shingle popper.

The present shingle removing tool, the shingle popper, is illustrated in FIG. 1. This shingle popper is generally like a garden shovel having a blade 10 and a handle 20. The blade 10 is made of a rigid material, such as sheet steel. Handle 20 having a multi-sided grip 21. The handle can be of any length, preferably 48 inches and can be made of any material, preferably wood base with rubber grip, to make it light. The handle connects to the blade through a handle-socket 22, which is an integral part of the blade 10.

Figure 2:
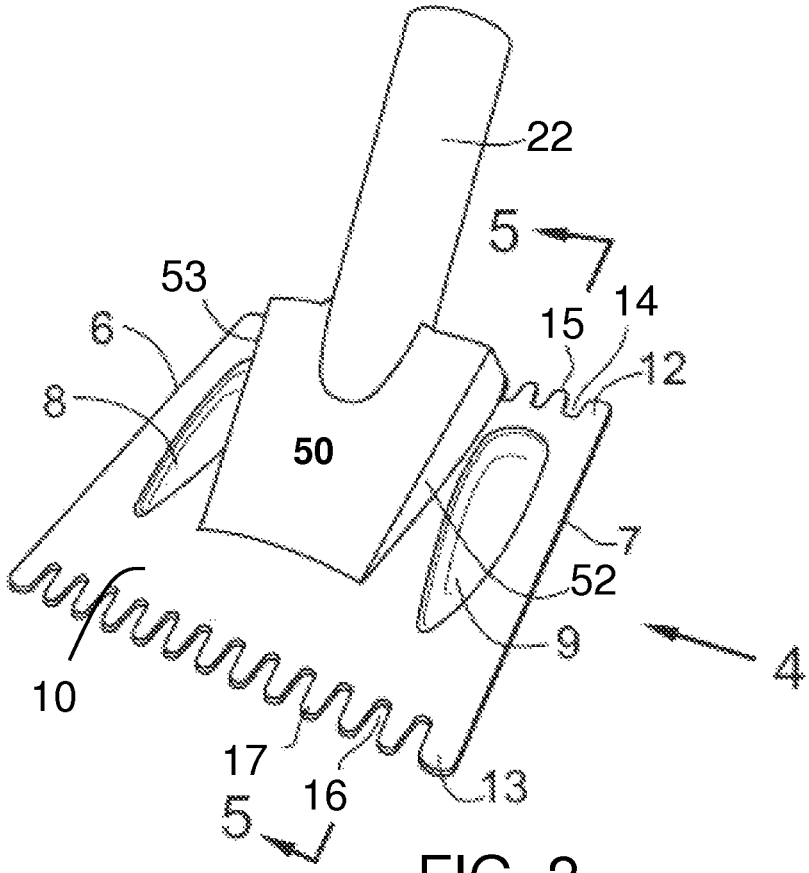
FIG. 2 is a tilted top view illustration of the present shingle popper.
Figure 3:
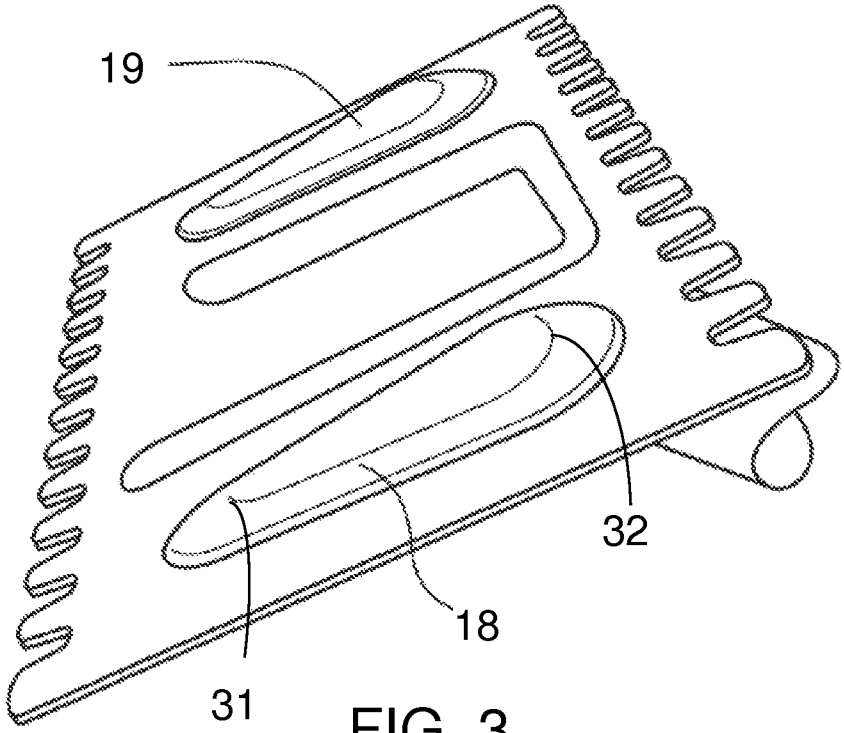
FIG. 3 is an illustration of the bottom side of the shingle popper.
Figure 4:
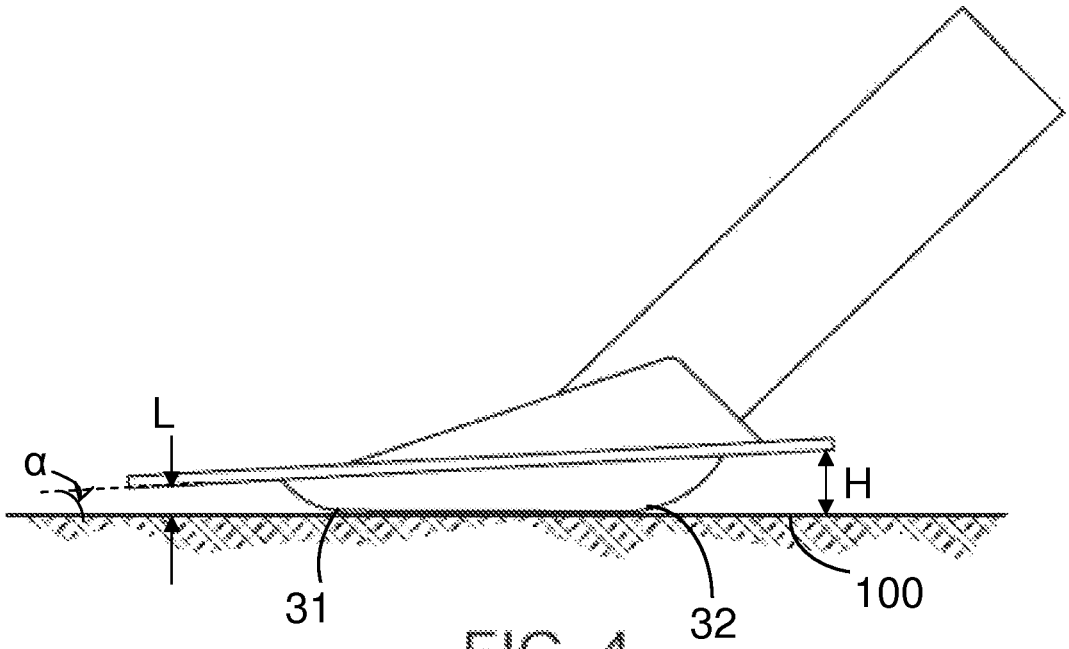
FIG. 4 is a side view illustration of the present shingle popper in its normal position on a flat surface.

Structure of the blade is illustrated in FIGS. 2 and 3. The blade has a back edge 12, a front edge 13, and side edges 6 and 7. The main features of the present blade are its two recesses 8 and 9 as illustrated in FIG. 2. A blank sheet metal is stamped or pressed to form the two recesses 8 and 9, such that they protrude on the back side of the blade forming protrusions 18 and 19 as illustrated in FIG. 3. The depth of each recess gradually decreases from the back to the front side of the blade, being deeper at the back side. This results in protrusions 18 and 19 having a higher elevation H at the back side with respect to that L at the front side of the blade as illustrated in FIG. 4. Therefore, when the device sits on the ground 100, along the surface of its protrusions 18 and 19, the blade surface 10 attains an angle, α, with respect to the ground as illustrated in FIG. 4.

This especially deformed blade has several advantages. One that the deformed blade, being constructed by a stamping or pressing process, is mechanical stronger than the initially flat blade. The advantages of having plastic deformations on a flat sheet of metal is known to experts in the field of solid mechanics. The designed recesses in the blade increase the strength of the material, as verified by laboratory tests conducted on the developed sample. Therefore, this shovel is longer lasting with lower probability of failure it its joints.

The second advantage of this blade is that it provides a true levering capability. Each protrusion has a front vertex 31 and a back vertex 32. These two vertices act as pivot point or fulcrum to fully utilize the levering force to reduce the required force for the removal of the nails.

The blade further comprises of plurality of nail receiving slots 14 on the back edge 12 of the blade, separated by plurality of teeth 15 extended outwardly from the back side 12. Similarly, there are plurality of nail receiving slots 16 on its front edge 13, separated by plurality of teeth 17 extended outwardly from the front side 13.

A tubular handle-socket 22 is attached to the top surface of the blade 10 at certain angle and closer to the back edge of the blade. The socket is preferably welded onto the blade for strong joint. The socket has means to connect to a handle. The connecting means can be plurality of apertures on its surface (e.g., 57 in FIG. 6) to screw or nail tight a wooded handle.

Figure 5:
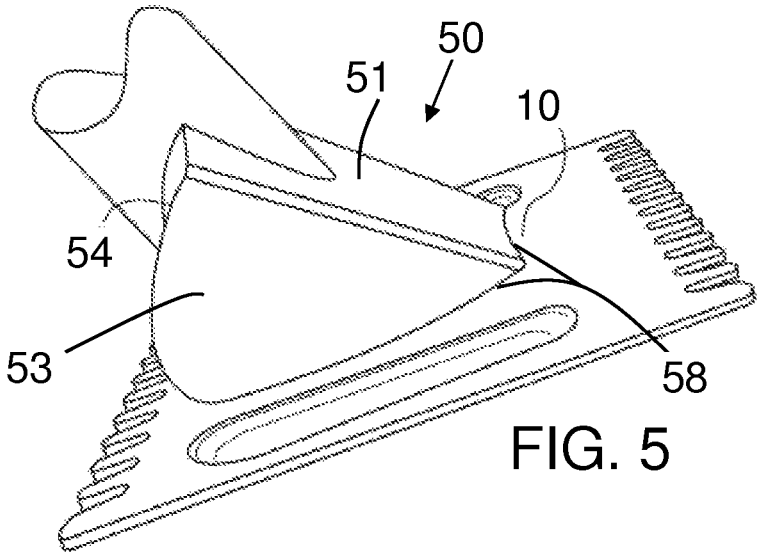
FIG. 5 is a side view illustration of the present shingle popper showing its top piece and a recess.
Figure 6:
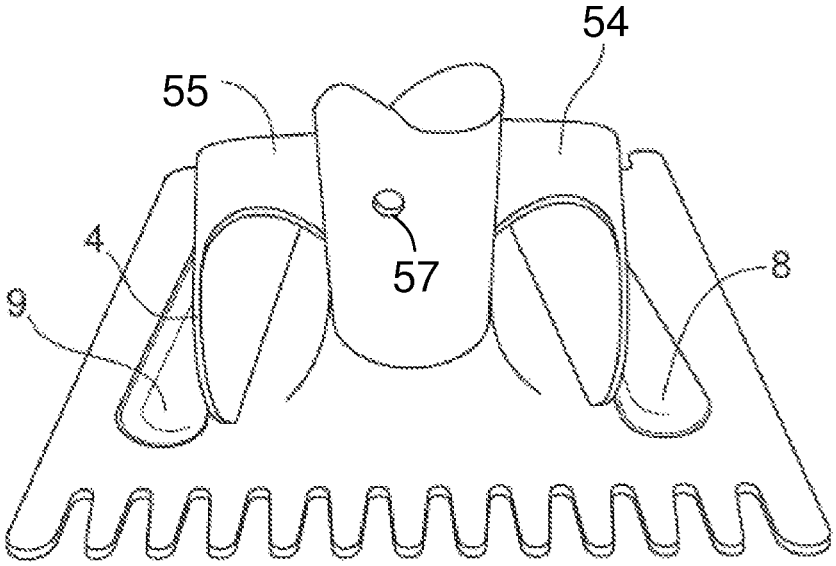
FIG. 6 is a back view illustration of the present shingle popper showing the foot pedestals of the top piece as well as the handle-socket.

Another novel element of the present shingle popper is a triple action top piece 50, as illustrated in FIGS. 5 and 6. A piece of sheet steel is cut to fit around the tubular handle socket and extending down onto the top surface of the blade. This piece has a flat slanted top surface 51, two vertical side sections 52 and 53, and back sections 54 and 55. The top surface 51 of the top piece 50 is acutely slanted with respect to the surface of the blade 10. This slanted piece 50 is welded onto the top surface of the blade 10 along its bottom edges 58. It is also welded onto the handle-socket 22 along its top edges 59.

The top piece has three functions. One is to push the shingle upward as the shovel is pushed underneath the shingle. The smooth angle of the top surface of this piece is so designed to help push a shingle up as the blade slides under the shingle. The second function of the top piece is that the upper sections of this piece 54 and 55 act as foot pedestals allowing an operator to use his/her foot to push the shovel inward underneath a shingle. Other shingle removal shovels sit flat on a surface with no means to push the shovel in other than the force applied by operator's hands holding the handle. And the third function of the top piece is to provide more structural strength to the shovel. Since this piece is welded to both the blade and the handle-socket, it makes the whole shovel structurally stronger.

In operation, the shingle popper is pushed under a shingle. Since the front edges of the popper have multiplicity of slots and teeth, nails easily become aligned with slots. The width of the slots 14 and 16 are small enough so that the head of the nails cannot pass through them. The operator pushes the handle 20 downward when the front edge 13 is used or upward when the back edge 12 is used to remove the nails.

Figure 7:
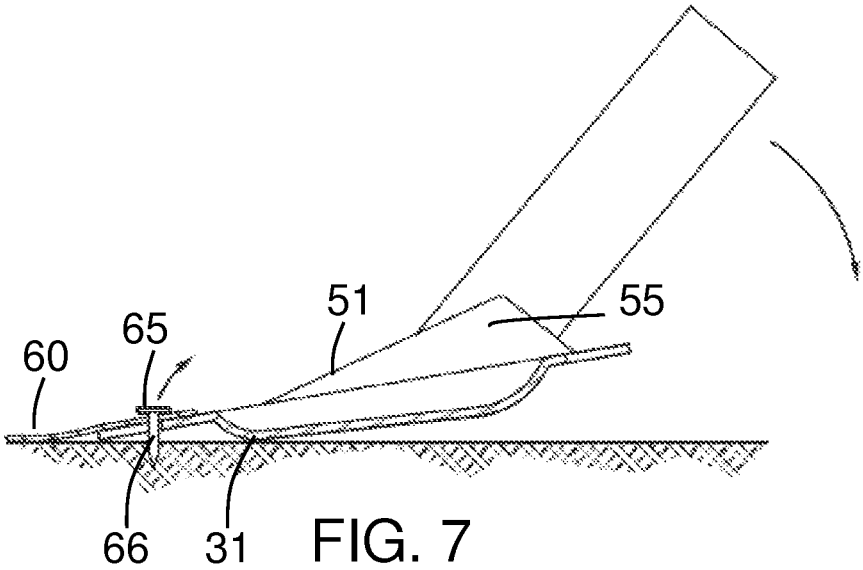
FIG. 7 is a side view illustration of the present shingle popper while leaning forward to remove nails by its front teeth.
Figure 8:
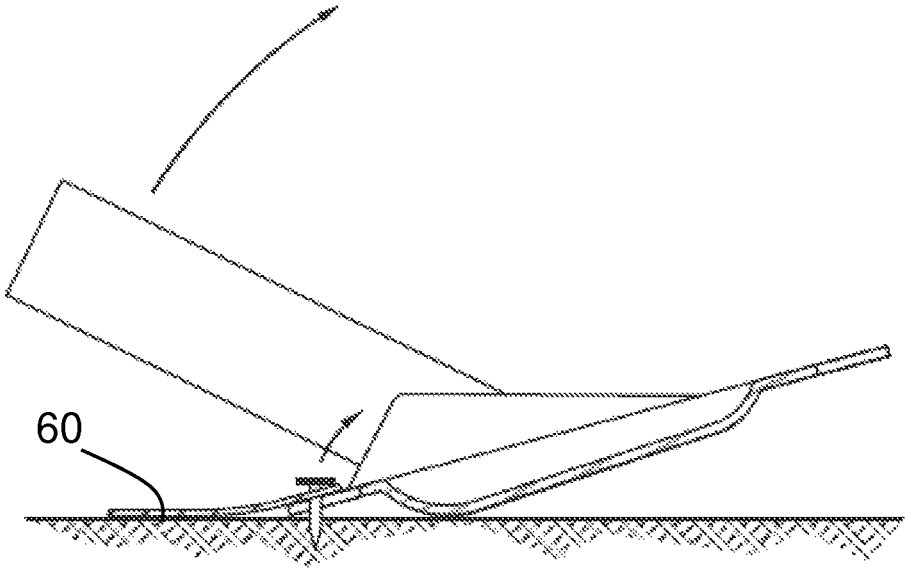
FIG. 8 is a side view of the present shingle popper when leaning backward to remove nails by its back teeth.

FIG. 7 shows the side view of the shingle popper placed underneath a shingle 60 and its nail 65. The shank of the nail 66 is placed between the teeth of the popper. The nail is removed by the front edge 13 of the device. The protrusions are designed to remove two standard size nails typically used to install shingles (1¼ and 1¾ inches nails) with single levering action. When the bottom protrusions sits on the ground, as in FIG. 4, the blade can remove 1¼ inch nails with one stroke of the handle 20. While, 1¾ inch nails can be removed once the tip of the blade is turned lower as in FIG. 7. Similarly, FIG. 8 illustrates the nail removal using the back side 12 of the popper. The double sided nail removal capability of the present device helps to reduce shingle removal time.

The present shingle popper, having the especially designed recesses and protrosions, as well as the extra slanted top piece, has higher strength and withstands larger forces as compared to the prior art devices with the same sheet metal characteristics. Also, the vertices of the protrusions act as pivot points for true levering action to let the operator remove nails with less force. Moreover, it allows a single stroke removal of standard size nails used on roofs. Plurality of slots and teeth on the front and the back edges of its blade eliminate the alignment time of the blade with nails, thus reducing the removal times. Moreover, more nails can be removed at one.

The described embodiment of the present invention and all of its specification, such as the number of slots on its front and back edges, the methods of joining tubular rod to the main surface, the angle of the top surface with respect to the horizon, the material that the device is made of, the geometry of the recesses and protrusions and other geometrical and physical attributes of the device can be changed while maintaining its essential characteristics. The described embodiments disclosed here are illustrative, not restrictive. The claims below dictate the scope of the invention. All variations which are in nature within the range set forth by the claims are embraced within the scope of the invention.

What is claimed is:

1. A shingle popper comprising:

a. a rigid metal blade having a top surface, and a bottom surface, said surfaces having a front edge, a back edge, and two side edges;

b. said blade deformed to have elongated recesses on the top surface from the back to the front edges, said recesses forming elongated protrusions on the bottom surface;

c. each said protrusion having a gradually decreasing elevation from the back edge to the front edge of the blade and wherein each said protrusion forming a front fulcrum and a back fulcrum, whereby said front fulcrum allows downward movement of the front edge and said back fulcrum allows downward movement of the back edge and whereby only the bottom side of said protrusions touch a surface;

d. said front edge having plurality of slots and teeth to remove nails;

e. said back edge having plurality of slots and teeth to remove nails;

f. a tubular handle-socket connected in an angle to the top surface of the blade; and g. a handle inserted and secured into the handle-socket.

2. The shingle popper of claim 1, further comprising a triple action top piece anchored between the top surface of the blade and the handle-socket, said piece having a forwardly slanted top surface, two backwardly slanted top surfaces, and two side walls, said piece fits around and welded to the tubular handle-socket and welded to the top surface of the blade, said piece having an angle with respect to the blade surface, whereby the triple action top piece provides structural support, allows smooth lifting of shingles, and provides a foot pedestal to push the blade under shingles by operator's foot.

3. The shingle popper of claim 1, wherein the blade, the handle-socket and the top piece being welded to each other.

4. The shingle popper of claim 1, wherein said front edge and said back edge having equally spaced and equal number of teeth.

* * * * *